US005300236A

United States Patent [19]

Bortolotti et al.

[11] Patent Number: 5,300,236

[45] Date of Patent: Apr. 5, 1994

[54] COMPOSITION FOR SOFTENING FABRICS

[75] Inventors: Fabrizio Bortolotti, Piacenza, Italy; David G. Evans, Oxton; Ian R. Kenyon, Gayton, both of England

[73] Assignee: Lever Brothers Company, Division of Conopco, Inc., New York, N.Y.

[21] Appl. No.: 414,976

[22] Filed: Sep. 29, 1989

[30] Foreign Application Priority Data

Sep. 30, 1988 [GB] United Kingdom ..... 8823008

[51] Int. Cl.[5] ..... D06M 10/06; D06M 10/08; C11D 3/02

[52] U.S. Cl. ..... 252/8.6; 252/174.21; 252/174.22; 252/174.25; 252/DIG. 1

[58] Field of Search ..... 252/8.6, 174.21, 174.22, 252/174.25, DIG. 1, 8.8

[56] References Cited

U.S. PATENT DOCUMENTS

| | | | |
|---|---|---|---|
| 3,769,222 | 10/1973 | Yurko | 252/DIG. 1 |
| 3,868,336 | 2/1975 | Mazzola et al. | 252/527 |
| 4,166,039 | 8/1977 | Wise | 252/89 |
| 4,713,193 | 12/1987 | Tai | 252/8.8 |
| 4,839,075 | 6/1989 | Puchta et al. | 252/8.7 |
| 4,956,112 | 9/1990 | Kenyon et al. | 252/8.6 |
| 4,961,866 | 10/1990 | Kenyon et al. | 252/8.6 |

FOREIGN PATENT DOCUMENTS

| | | |
|---|---|---|
| 011340 | 5/1980 | European Pat. Off. . |
| 0028432 | 5/1981 | European Pat. Off. . |
| 277571 | 1/1988 | European Pat. Off. . |
| 0287343 | 10/1988 | European Pat. Off. . |
| 2247530 | 5/1975 | France . |
| 2500475 | 8/1982 | France . |
| 2524901 | 10/1983 | France . |
| 1400898 | 7/1975 | United Kingdom . |
| 1462134 | 1/1977 | United Kingdom . |
| 1462484 | 1/1977 | United Kingdom . |
| 2095274 | 9/1982 | United Kingdom . |
| 2097419 | 11/1982 | United Kingdom . |
| 2121843 | 1/1984 | United Kingdom . |
| 2138037 | 10/1984 | United Kingdom . |
| 2138037 | 10/1984 | United Kingdom . |
| 2182051 | 5/1987 | United Kingdom . |
| 2201172 | 8/1988 | United Kingdom . |

*Primary Examiner*—Paul Lieberman
*Assistant Examiner*—Michael P. Tierney
*Attorney, Agent, or Firm*—A. Kate Huffman

[57] ABSTRACT

A particulate composition useful in the softening of fabrics from a wash liquor, the composition comprising a fabric softening clay material and a nonionic surfactant system which consists of one or more nonionic surfactants, wherein the nonionic surfactant system exists as a cloudy phase, at 1% concentration in water, somewhere in the range of 0° C. to 80° C., the weight ratio of the clay to the nonionic surfactant system is from 2:3 to 20:1, and the moisture content of the composition, as measured by the water loss at 135° C., is from 7.5% to 12% by weight.

9 Claims, No Drawings

COMPOSITION FOR SOFTENING FABRICS

BACKGROUND

This invention relates to a composition for softening fabrics and in particular to such a composition which is particulate and capable of imparting a softening benefit to fabric during a wash process.

A number of materials have been suggested in the art for providing softening-in-the-wash benefits. These include certain classes of clay materials, especially smectite clays. Thus GB 1400898 (Procter and Gamble) suggests the use of smectite clays having a relatively high exchange capacity. While some fabric softening benefit can be obtained from detergent compositions containing fabric softening clays, this benefit is generally some way short of that which can be obtained by the application of softening materials to fabrics in the rinse step of a laundering process. Therefore, there is a desire to boost the performance of fabric softening clays in the wash. GB 2138037 (Colgate) proposes that the performance of fabric softening clays can be improved by the removal of grit therefrom and by their addition to the detergent composition as separate agglomerated particles, the clay being agglomerated with a binder, such as sodium silicate.

Several disclosures in the art suggest that the performance of fabric softening clays is especially poor in the presence of nonionic surfactants. Thus, for example, GB1462484 (Procter & Gamble) proposes that in the presence of nonionic surfactants it is necessary to use smectite clays which have been rendered organophilic by an exchange reaction with quarternary ammonium compounds. GB 1400898, referred to above, is silent on the presence of nonionic surfactants. Also, European Patent Specification EP-11340-A (Procter & Gamble) teaches that, in a composition which includes a mixture of a smectite clay and a tertiary amine for softening-in-the-wash, when anionic surfactants are employed it is preferred that nonionic surfactants be absent, but if mixtures containing nonionics are used, it is preferred that the anionic forms the major part of the mixture.

It is apparent therefore that a prejudice has built up against the use of nonionic surfactants in combination with clays for softening-in-the-wash, especially in the presence of anionic surfactants.

DISCLOSURE OF THE INVENTION

We have surprisingly found however that if certain nonionic surfactant materials are carried on the clay, at a specified level relative thereto, and the moisture content of the composition is controlled, the fabric softening performance of clay can in fact be enhanced.

The nonionic surfactant or mixture thereof which is essential to the present invention exists as a cloudy phase at 1% concentration in water at a temperature somewhere between 0° C. and 80° C. preferably between 0° C. and 15° C. To obtain the benefits of the invention it is necessary that the weight ratio of the clay to this nonionic surfactant system is from 2:3 to 20:1, preferably from 1:1 to 10:1. Any other nonionic surfactant material present which does not exist as a cloudy phase between these specified temperatures is not counted for the purposes of calculating the required clay to nonionic ratio.

The invention makes use of a fabric softening clay material carrying the specified nonionic surfactant system in the given proportions. Thus it is preferred that the clay and nonionic surfactant system are in intimate contact with each other. More specifically the composition may be in the form of clay agglomerates which are formed of fine particle size clay bound together with a binder which contains the nonionic surfactant system.

In this embodiment it is preferred that the ratio of the clay to the nonionic surfactant system in the agglomerate is from 3:1 to 20:1, most preferably 4:1 to 10:1.

These agglomerates may be formed by any conventional granulating process, the binder for the clay particles being for example, water, inorganic salts or organic binding agents. The nonionic surfactant system may be included with the binder or sprayed on or admixed with pre-formed granulates provided that the nonionic is sufficiently mobile to be closely associated with the clay.

When water is or comprises the binding agent, or in any case, the moisture content of the composition must be between 7.5% and 12% by weight, preferably from 8% to 10%. The term "moisture" in this context is not necessarily the total water content, but rather it is the water which is lost from the composition by drying in a static environment at 135° C. to a constant weight. Usually, when freshly prepared, the clay/nonionic granules will have a higher moisture content, such as, for example, from 10% to 16% moisture, and will therefore be too sticky for use, so that some post-drying is necessary. Thus it is an embodiment of this invention to granulate the clay and the nonionic surfactant in the presence of water and subsequently dry the so-formed clay/nonionic granules to a lower moisture content. As the moisture content is reduced towards the critical lower limit, there is an increase in the bulk density of the granules, a major improvement in dynamic flow rate, compressibility and cohesivity. Friability is not adversely affected and the nonionic content and softening performance are similar to that of the freshly prepared granules. Also, where clay of poor colour is used, drying to a moisture content within the preferred range can improve whiteness of the granules. Further drying to below the critical range results in loss of dispersibility, loss of nonionic from the granules and loss of softening performance. When post-drying high moisture content clay/nonionic granules, a drying air temperature of 85°-90° C. has been found to be suitable. However, loss of the nonionic surfactant by vapourisation can be reduced by the use of a lower drying air temperature, such as 50°-60° C.

Where the colour of the raw clay material is poor, it is possible to further granulate or coat the clay/nonionic granules with a white or more acceptably coloured pigment material. Particularly useful coating materials include ultramarine blue, zeolite, calcite, white clay, talc and titanium dioxide. The use of a binding agent in this process is helpful, such as a 30% aqueous solution of a maleic acid/acrylic acid copolymer (e.g. Sokalan CP5 ex BASF).

Where other ingredients are present in the composition, the clay and the nonionic surfactant system will together preferably make up the major part of the composition to ensure that the advantageous intimate contact is retained.

All the above forms of the composition may contain other ingredients, especially ingredients useful in the washing of fabrics. Alternatively, such other ingredients may be added separately. In either case a fully formulated fabric washing product may be obtained, and it is preferred that overall such products contain at least from 2% to 50%, most preferably from 5% to 40% by weight of a detergent active material, which amount includes the nonionic surfactant system associated with the fabric softening clay and also at least one anionic surfactant; from 20% to 70%, most preferably from 25% to 50% by weight, of a detergency builder material and from 1.5% to 35%, most preferably from 4% to 15% by weight of fabric softening clay material having associated with it the nonionic surfactant system.

THE NONIONIC SURFACTANT SYSTEM

The nonionic surfactant system of the present invention exists as a cloudy phase somewhere in the temperature range of 0° C. to 80° C., preferably 0° C. to 15° C. in distilled water at 1% concentration. In practise this means that the system has a cloud point of not more than 80° C., preferably not more than 15° C. Cloud point is a term well known in the art, for example from Surface Active Ethylene Oxide Adducts by N. Schonfeldt, Pergamon Press 1969, pp 145 to 154. In general terms the cloud point of a surfactant material is the temperature at which association between the surfactant and water molecules through hydrogen bonding breaks down, leading to the separation of surfactant rich and water rich phases and a consequential increase in turbidity or cloudiness.

The cloud point correlates approximately to the hydrophilic—lipophilic balance (HLB) of the surfactant system and it is therefore preferred that the HLB should be less than 13.5, such as not more than 12.0, ideally less than 9.5. The HLB should preferably be above 6.0, most preferably above 8.0 to provide sufficient detergency.

Suitable nonionic detergent compounds which may be used include in particular the reaction products of compounds having a hydrophobic group and a reactive hydrogen atom, for example aliphatic alcohols, acids, amides or alkyl phenols with alkylene oxides, especially ethylene oxide either alone or with propylene oxide. Specific nonionic detergent compounds are alkyl ($C_6$–$C_{22}$) phenols-ethylene oxide condensates, the condensation products of aliphatic ($C_8$–$C_{18}$) primary or secondary linear or branched alcohols with ethylene oxide, and products made by condensation of ethylene oxide with the reaction products of propylene oxide and ethylenediamine. Other so-called nonionic detergent compounds include long chain tertiary amine oxides, long chain tertiary phosphine oxides and dialkyl sulphoxides.

Where, for example, alkylene oxide adducts of fatty materials are used as the nonionic detergent compounds, the number of alkylene oxide groups per molecule has a considerable effect upon the cloud point as indicated by the Schonfeldt reference mentioned above. The chain length and nature of the fatty material is also influential, and thus the preferred number of alkylene oxide groups per molecule depends upon the nature and chain length of the fatty material. We have found for example that where the fatty material is a fatty alcohol having about 13 to 15 carbon atoms, the adduct having 3 ethylene oxide groups per molecule has a cloud point of less than 0° C. and is therefore suitable for use in the present invention. A similar surfactant having 7 ethylene oxide groups per molecule has a cloud point of about 48° C. and is therefore less preferred. Further ethoxylation raises the cloud point still higher. Thus the similar surfactant with 11 ethylene oxide groups per molecule has a cloud point higher than 80° C. and is therefore unsuitable.

Where mixtures of surfactant materials are used, it is the properties of the individual components of the mixture rather than their average properties which are important.

Whilst not wishing to be limited by theory we believe that the enhancement in softening performance results from improved dispersion of the clay material. This improvement in dispersion is a consequence of the action of the nonionic surfactant providing that in use it is released by the clay into the wash liquor. The strength of binding of the nonionic to the clay depends upon the polarity of the nonionic, therefore highly polar materials, (high HLB and cloud point), are more strongly bound and are not released to the wash liquor resulting in no improvement or even inhibition of dispersion. Thus only materials with a cloud point less than 80° C. should be closely associated with the clay and where mixtures are used all components of the mixture should preferably fulfill this criteria.

For the purposes of determining the suitable clay to nonionic ratio, only those nonionic materials which exist in the cloudy phase are counted. With some mixtures of nonionic surfactants, especially mixtures of surfactants which do not have closely related structures, some separation may occur so that some components of the mixture form the cloudy phase while others, generally the more soluble components, exist only in the clear phase. Analysis of the cloudy phase, using methods well known in the art, can determine the content of the cloudy phase in these circumstances.

THE CLAY MATERIAL

The clay containing material may be any such material capable of providing a fabric softening benefit. Usually these materials will be of natural origin containing a three-layer swellable smectite clay which is ideally of the calcium and/or sodium montmorillonite type. It is possible to exchange the natural calcium clays to the sodium form by using sodium carbonate, as described in GB 2 138 037 (Colgate). The effectiveness of a clay containing material as a fabric softener will depend inter alia on the level of smectite clay. Impurities such as calcite, feldspar and silica will often be present. Relatively impure clays can be used provided that such impurities are tolerable in the composition. In calculating the suitable clay to nonionic ratios however, it is the amount of smectite clay present which is important.

OPTIONAL COMPONENTS

When the compositions of the invention, or the fabric washing products containing them, contain a detergent active material in addition to the nonionic surfactant system referred to above, this may be selected from other nonionic detergent active materials, anionic detergent active materials, zwitterionic or amphoteric detergent active materials or mixtures thereof.

The anionic detergent active materials are usually water-soluble alkali metal salts of organic sulphates and sulphonates having alkyl radicals containing from about 8 to about 22 carbon atoms, the term alkyl being used to include the alkyl portion of higher acyl radicals. Examples of suitable synthetic anionic detergent compounds are sodium and potassium alkyl sulphates, especially those obtained by sulphating higher ($C_8$–$C_{18}$) alcohols produced for example from tallow or coconut oil, sodium and potassium alkyl ($C_9$–$C_{20}$) benzene sulphonates, particularly sodium linear secondary alkyl ($C_{10}$–$C_{15}$) benzene sulphonates; sodium alkyl glyceryl ether sulphates, especially those ethers of the higher alcohols derived from tallow or coconut oil and synthetic alcohols derived from petroleum; sodium coconut oil fatty monoglyceride sulphates and sulphonates; sodium and potassium salts of sulphuric acid esters of higher ($C_8$–$C_{18}$) fatty alcohol-alkylene oxide, particularly ethylene oxide, reaction products; the reaction products of fatty acids such as coconut fatty acids esterified with isethionic acid and neutralised with sodium hydroxide; sodium and potassium salts of fatty acid amides of methyl taurine; alkane monosulphonates such as those derived by reacting alpha-olefins ($C_8$–$C_{20}$) with sodium bisulphite and those derived from reacting paraffins with $SO_2$ and $Cl_2$ and then hydrolysing with a base to produce a random sulphonate; and olefin sulphonates, which term is used to describe the material made by reacting olefins, particularly $C_{10}$–$C_{20}$ alpha-olefins, with $SO_3$ and then neutralising and hydrolysing the reaction product. The preferred anionic detergent compounds are sodium ($C_{11}$–$C_{15}$) alkyl benzene sulphonates and sodium ($C_{16}$–$C_{18}$) alkyl sulphates.

When the compositions of the invention, or the fabric washing products containing them, contain a detergency builder material this may be any material capable of reducing the level of free calcium ions in the wash liquor and will preferably provide the composition with other beneficial properties such as the generation of an alkaline pH, the suspension of soil removed from the fabric and the dispersion of the fabric softening clay material.

Examples of phosphorus-containing inorganic detergency builders, when present, include the water-soluble salts, especially alkaline metal pyrophosphates, orthophosphates, polyphosphates and phosphonates. Specific examples of inorganic phosphate builders include sodium and potassium tripolyphosphates, phosphates and hexametaphosphates.

Examples of non-phosphorus-containing inorganic detergency builders, when present, include water-soluble alkali metal carbonates, bicarbonates, silicates and crystalline and amorphous alumino silicates. Specific examples include sodium carbonate (with or without calcite seeds), potassium carbonate, sodium and potassium bicarbonates and silicates.

Examples of organic detergency builders, when present, include the alkaline metal, ammonium and substituted ammonium polyacetates, carboxylates, polycarboxylates, polyacetyl carboxylates and polyhydroxsulphonates. Specific examples include sodium, potassium, lithium, ammonium and substituted ammonium salts of ethylenediaminetetraacetic acid, nitrilotriacetic acid, oxydisuccinic acid, melitic acid, benzene polycarboxylic acids and citric acid.

Apart from the ingredients already mentioned, a number of optional ingredients may also be present, either as part of the clay containing compositions or as part of the overall fabric washing product.

Examples of other ingredients which may be present in the composition include the lather boosters, lather depressants, oxygen-releasing bleaching agents such as sodium perborate and sodium percarbonate, peracid bleach precursors, chlorine-releasing bleaching agents such as tricloroisocyanuric acid, inorganic salts such as sodium sulphate, and, usually present in very minor amounts, fluorescent agents, perfumes, enzymes such as proteases and amylases, germicides and colourants.

EXAMPLES

The invention will now be illustrated by the following non-limiting examples.

EXAMPLE 1

Clay/nonionic granules were prepared by spraying 4 parts of clay ("Prassa" high c. e. c. clay ex Colin Stewart Minerals) with 1 part of Synperonic A3 (a nonionic surfactant ex ICI which is a $C_{13}$–$C_{15}$ alcohol ethoxylated with approximately 3 moles of ethylene oxide per molecule and having a cloud point below 0° C.). The moisture content of these granules as freshly prepared was 15.9%.

60 kilograms of the granules were dried on a fluidised bed dryer using drying air having a temperature of 85°–90° C. The starting bed temperature was about 25° C. and after 30 minutes this had risen to about 80° C. Samples of the granules were removed after various times and tested for various physical properties. Additionally their softening performance was investigated using standard techniques.

The results obtained are set out in Table I.

EXAMPLE 2

Example 1 was repeated with the difference that the drying air in the fluidised bed dryer was 30°–60° C. The maximum bed temperature was 40° C. The results are set out in Table II.

TABLE I

| Sample | Drying Time (mins) | Bulk Density (Kg/l) | DFR[1] (ml/sec) | C[2] (%) | UCT[3] (Kg) | Moisture % (135° C.) | Nonionic (%) | Softening Performance |
|---|---|---|---|---|---|---|---|---|
| A | 0 | 0.66 | 118 | 28 | 3.2 | 15.9 | 18.0 | best |
| B | 7 | 0.82 | 147 | 10 | 0.3 | 10.1 | 18.3 | similar to A |
| C | 14 | 0.81 | 153 | 7 | <0.05 | 7.5 | 17.3 | poorer than A |
| D | 21 | 0.83 | 153 | 4 | <0.05 | 5.4 | 17.4 | similar to C |
| E | 28 | 0.85 | 153 | 6 | <0.05 | 4.8 | 17.1 | worst |

Notes
[1]Dynamic flow rate
[2]Compressibility
[3]Cohesivity

TABLE II

| Sample | Drying Time (mins) | Bulk Density (Kg/l) | DFR (ml/sec) | C (%) | UCT (Kg) | Moisture % (135° C.) | Nonionic (%) |
|---|---|---|---|---|---|---|---|
| A | 0 | 0.68 | 109 | 23 | 3.2 | 12.9 | 19.4 |
| B | 5 | 0.74 | 120 | 14 | 1.7 | 11.4 | 19.3 |
| C | 12 | 0.78 | 120 | 11 | 0.7 | 8.1 | 19.9 |
| D | 19 | 0.82 | 126 | 7 | 0.4 | 7.6 | 20.2 |
| E | 26 | 0.83 | 120 | 5 | 0.4 | 7.6 | 17.9 |
| F | 40 | 0.83 | 120 | 6 | 0.3 | 6 2 | 18.0 |

We claim:

1. A particulate composition useful in the softening of fabrics from a wash liquor, the composition comprising a fabric softening clay material and a nonionic surfactant system which consists of one or more nonionic surfactants, wherein the nonionic surfactant system has a cloud point of not more than 48° C. at 1% concentration in distilled water, the clay serves as a carrier for the nonionic surfactant system, the clay and the nonionic surfactant system form a major proportion of the particulate composition, the weight ratio of the clay to the nonionic surfactant system is from 2:3 to 20:1, and the moisture content of the composition, as measured by the water loss at 135° C., is from 7.5% to 12% by weight.

2. A particulate composition as claimed in claim 1 wherein the moisture content is from 8% to 10% by weight.

3. A particulate composition as claimed in claim 1 wherein the nonionic surfactant system exists as a cloudy phase, at 1% concentration in water, in the range 0° C. to 15° C.

4. A particulate composition as claimed in claim 1 wherein the moisture content is from 8% to 10% by weight and the nonionic surfactant system exists as a cloudy phase, at 1% concentration in water, in the range 0° C. to 15° C.

5. A particulate composition as claimed in claim 1 wherein the weight ratio of the clay to the nonionic surfactant system is from 1:1 to 10:1.

6. A particulate composition as claimed in claim 1 in the form of agglomerates.

7. A method of preparing a composition according to claim 1, which comprises granulating the clay material with the nonionic surfactant system in the presence of water to a moisture content in excess of 10% by weight, and subsequently drying the so formed granules to the required moisture content.

8. A fabric washing product comprising a particulate composition according to claim 1 together with other ingredients external to the particles of said composition which other ingredients comprise a detergency builder material in an amount of 20% to 70% by weight of the fabric washing product, the amount of said particulate composition in the fabric washing product being such that the product contains from 1.5% to 35% by weight of said fabric softening clay material.

9. A fabric washing product according to claim 8 which contains from 1.5% to 15% by weight of said fabric softening clay material.

* * * * *